US005979710A

United States Patent [19]

Willemsen et al.

[11] Patent Number: 5,979,710

[45] Date of Patent: Nov. 9, 1999

[54] COLLAPSIBLE CONTAINER FOR FLUIDS

[76] Inventors: Michael G. Willemsen; Louis R. H. A. Willemsen, both of Rijksweg 37, NL-4849 BM Dorst, Netherlands

[21] Appl. No.: 09/117,624

[22] PCT Filed: Feb. 6, 1997

[86] PCT No.: PCT/NL97/00037

§ 371 Date: Feb. 3, 1999

§ 102(e) Date: Feb. 3, 1999

[87] PCT Pub. No.: WO97/29020

PCT Pub. Date: Aug. 14, 1997

[30] Foreign Application Priority Data

Feb. 12, 1996 [NL] Netherlands ..... 1002300

[51] Int. Cl.[6] ..... G01F 11/00

[52] U.S. Cl. ..... 222/215

[58] Field of Search ..... 222/206, 215, 222/341.1

[56] References Cited

U.S. PATENT DOCUMENTS

| | | | |
|---|---|---|---|
| 2,685,316 | 8/1954 | Krasno . | |
| 3,412,907 | 11/1968 | Faso | 222/215 |
| 3,580,427 | 5/1971 | Clarke | 222/215 |
| 4,079,111 | 3/1978 | Uhlig . | |
| 4,898,306 | 2/1990 | Pardes . | |

FOREIGN PATENT DOCUMENTS

| | | |
|---|---|---|
| 512839 | 10/1980 | Australia . |
| 1114691 | 5/1968 | United Kingdom . |
| 96/22919 | 8/1996 | WIPO . |

*Primary Examiner*—Philippe Derakshani
*Attorney, Agent, or Firm*—Banner & Witcoff, Ltd

[57] ABSTRACT

The invention relates to a container for a small quantity, for instance a portion, of fluid material such as liquid, gas, paste or gel, wherein the container is adapted to reduce its volume through the exertion of external forces and the container is provided with a closure, wherein the container comprises two walls (7, 8) which are each rigid at least on their edge and which are connected by a flexible wall (9, 10). The container is preferably provided with a closure which is breakable by internal pressure on the container.

7 Claims, 3 Drawing Sheets

FIG. 4
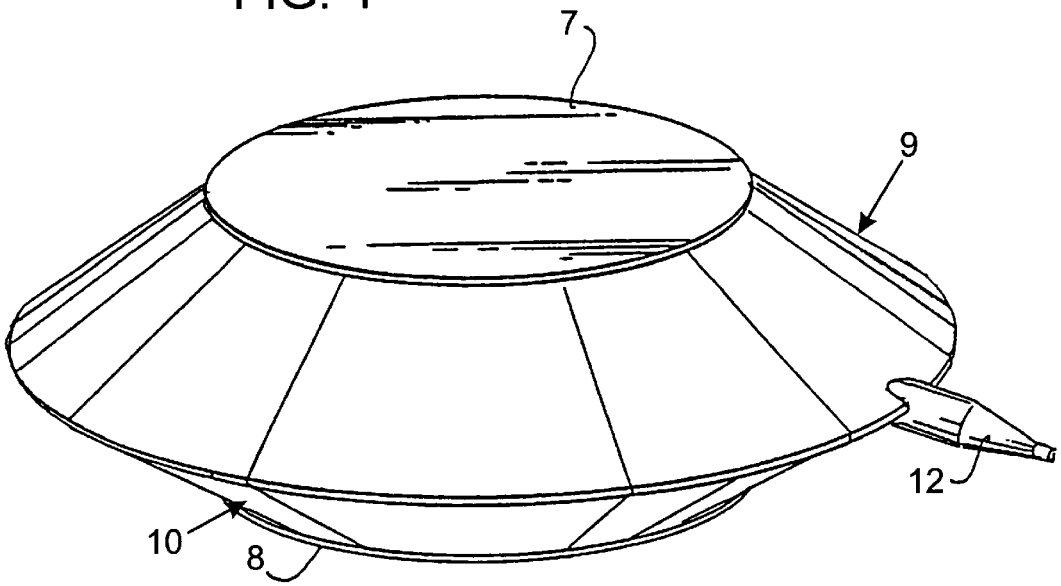
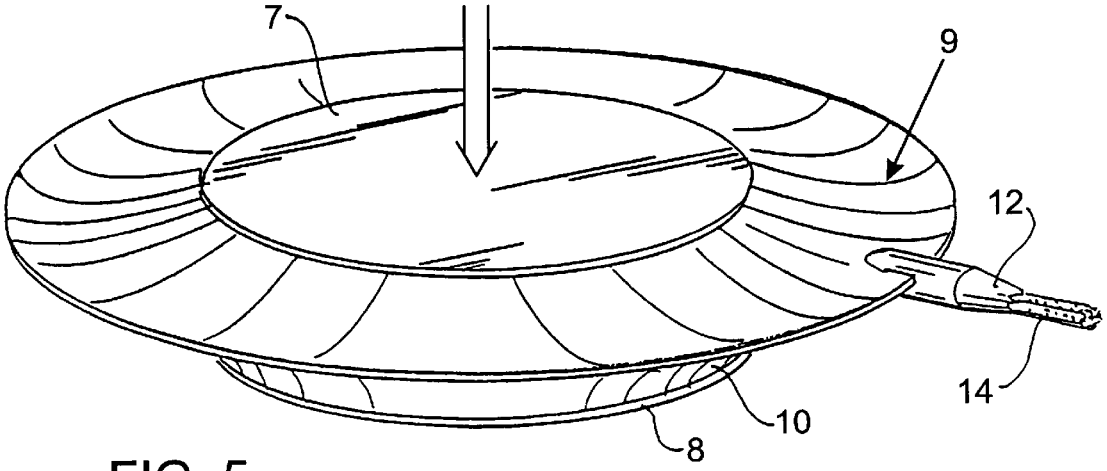
FIG. 5

COLLAPSIBLE CONTAINER FOR FLUIDS

SUMMARY OF THE INVENTION

The invention relates to a container for a small quantity, for instance a portion, of fluid material such as liquid, gas, paste or gel, wherein the container is adapted to reduce its volume through the exertion of external forces and the container is provided with a closure.

BACKGROUND OF THE INVENTION

Such containers are generally known, for instance in the form of tubs for condensed milk closed by means of aluminium foil.

Such prior art containers have the drawback that when the cover is removed there is a considerable chance of leakage and spillage.

From GB-A-1 114 691 is known a container for fluid material wherein the container is adapted to reduce its volume through the exertion of external forces.

This is a container which is costly in mass production.

BRIEF DESCRIPTION OF THE INVENTION

The object of the present invention is to provide a container which can be manufactured at lower cost.

This object is achieved in that the container comprises two walls which are each rigid at least on their edge and which are connected by a flexible wall.

These steps result in a simpler and therefore less expensive production process, for instance by using a moulding process for the rigid walls and possibly a part of the flexible walls, and subsequently applying a blow moulding or deep-draw process to form the flexible walls.

It will be apparent that the container is not only intended for liquids such as condensed milk or lemon squash but that it is also suitable for packaging gas, for instance gas as fuel for lighters, or for gel-like products such as mayonnaise, sauce for french fries, or for pastes such as glue.

The closure is preferably arranged on a discharge spout adjoining an edge.

This step has the advantage that the closure, which is usually formed by a removable or displaceable element, is formed together with a rigid wall or- if this latter is formed by a rigid edge-is formed together with a cover element arranged on the rigid edge.

According to another preferred step the discharge spout is provided with a closure to be removed manually from its position closing the discharge spout.

With this step the container is properly closed until shortly before use; the closure is not opened by external pressure on the container.

According to a preferred embodiment the edges of the rigid walls are each located substantially in a flat plane, which planes extend substantially parallel when a container is full. This embodiment combines a simple production process, as already known for instance in the case of condensed milk tubs, with the advantages of the invention. For this purpose the manufacturing process for the tubs has only to be adapted to the collapsibility of the side walls. This can be performed for instance by a blow moulding process.

Other attractive preferred embodiments are designated in the sub-claims.

BRIEF DESCRIPTION OF THE DRAWINGS

The present invention will be elucidated hereinbelow with reference to the annexed drawings, in which:

FIG. 4 is a perspective view of a variant of the embodiment shown in FIG. 2;

FIG. 5 is a perspective view of the variant shown in FIG. 4 in collapsed situation.

DETAILED DESCRIPTION OF THE INVENTION

Figure 1:
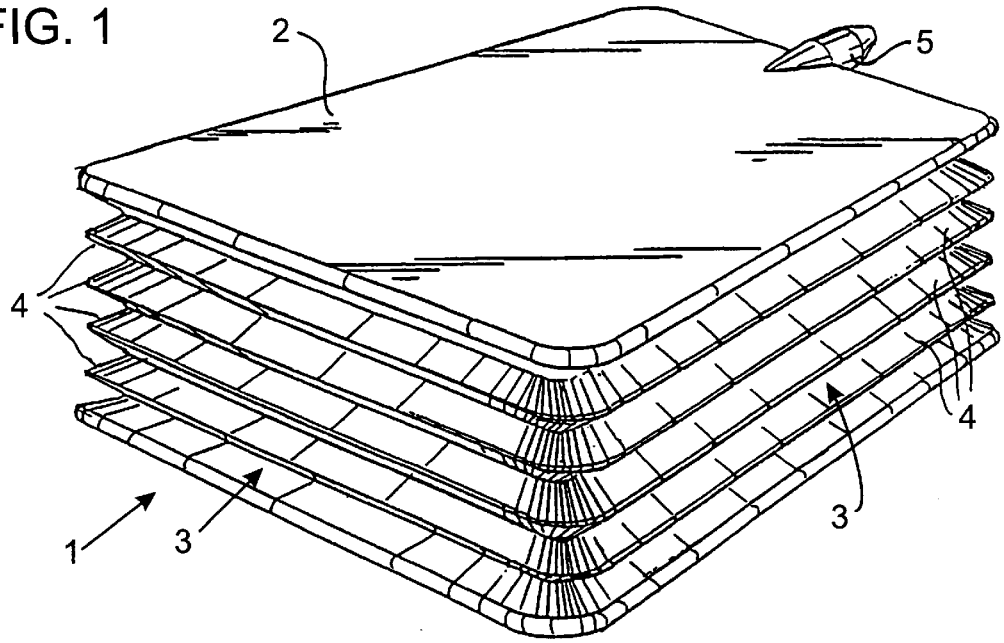
FIG. 1 shows a perspective view of a first embodiment of the present invention.

The container 1 shown in FIG. 1 comprises a flat upper surface 2 and a lower surface not shown in the drawing. Both the upper surface 2 and the lower surface are sufficiently rigid for this application. The rigid upper surface 2 and the rigid lower surface are mutually connected on their edge by side walls 3 which allow of a large measure of flexibility. Side surfaces 3 are folded in concertina shape, wherein the folds 4 extend substantially parallel to the edges of the rigid surfaces.

Arranged on one edge of upper surface 2 is a spout 5 which is provided with an internal channel and which is adapted to guide the content of container 1 when the upper surface 2 is pressed in the direction toward the lower surface. The spout 5 is preferably provided with a closure (not shown in the drawing) which can be removed manually to dispense the fluid. This closure can be formed for instance by a thin wall which is formed simultaneously with forming of the spout and which can be removed for instance by means of a pull tab.

It is possible to manufacture such a container from many types of material. It will also be apparent that such a container can preferably be manufactured from plastic, and particularly from those plastics which can result in a rigid surface when sufficiently thick and which, when the wall thickness is sufficiently thin, ensure the flexibility of such a wall preferably embodied in a concertina configuration.

It is pointed out here that it may also be useful to provide the rigid walls with reinforcement ribs and the like. These can be embodied internally but also externally, wherein external placing of reinforcement ribs facilitates grasping of the container with the fingers.

It is noted that the dimensions of such a container are small; the dimensions are chosen such that in the case of foodstuffs it is suitable to contain a single portion.

In order to remove the full contents from the container, one of the two surfaces can be provided with an inward directed recess.

Although the foregoing embodiment relates to a container with rectangular rigid surfaces, it will be apparent that such rigid surfaces may also take other forms, for instance square, polygonal, round or oval.

It will also be apparent that it is not necessary for the rigid surfaces to be mutually parallel when the container is full; it is also possible to mutually connect these surfaces on one side by a hinge-like construction, which must of course be fluid-tight, and to move the surfaces toward each other in the manner of a bellows, whereby the content flows out through spout 5.

Figure 2:
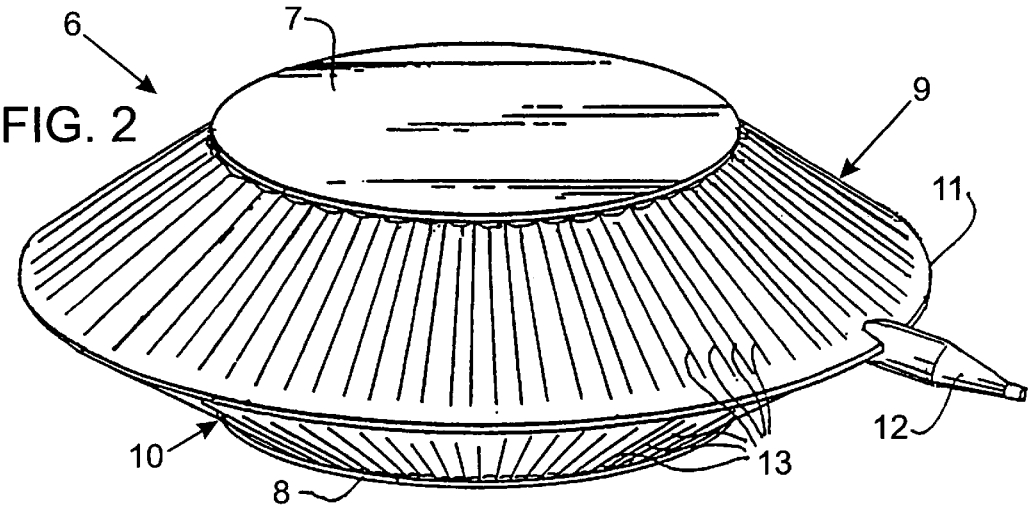
FIG. 2 shows a perspective view of a second preferred embodiment of the present invention.

FIG. 2 shows an alternative embodiment of a container according to the invention. The container 6 depicted therein once again comprises a rigid upper surface 7 and a rigid lower surface 8, only an edge of which can be seen in the drawing. Both rigid surfaces 7,8 take a round form. Extending round the rigid surface 7 in the manner of a skirt is a flexible surface 9 which is connected on its outer edge to a flexible surface 10 likewise extending in the manner of a skirt from the rigid surface 8. The two surfaces 9,10 are mutually connected along an edge 11. Arranged along the edge is a spout 12 through which the content of the container can flow out when the rigid surfaces 7,8 are moved toward each other. The two flexible surfaces 9,10 are provided with radially extending folds 13 which provide the flexible surfaces 9,10 with the relevant flexibility.

Figure 3:
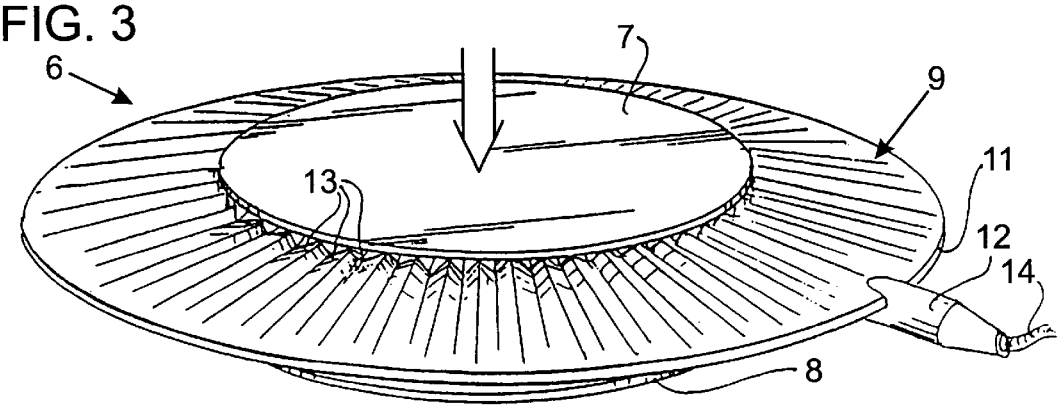
FIG. 3 is a perspective view of the embodiment shown in FIG. 2 of the present invention, but then in collapsed situation.

FIG. 3 shows the collapsed form of the container shown in FIG. 2. The content of the container flows out through discharge aperture 14 of spout 12.

FIG. 4 shows a variant of the container depicted in FIG. 2; in the container shown in FIG. 4 the material from which the flexible walls 9,10 are manufactured is of a great flexibility such that they do not have to be provided with folds; collapsing of the surfaces 7,8 results in a deformation of the flexible surfaces 9,10 as shown in FIG. 5.

Figure 6:
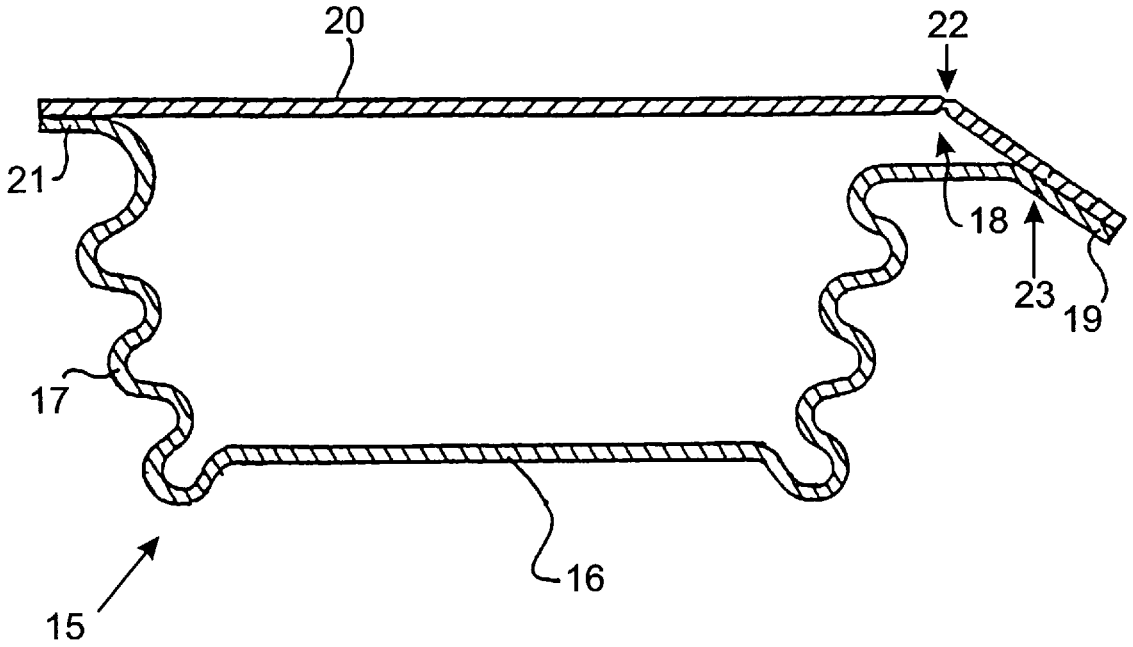
FIG. 6 shows a cross sectional view of a third embodiment.

Finally, FIG. 6 shows a third embodiment which is formed by a plastic container 15 formed by a substantially flat base 16 and a substantially cylindrical wall 17. The wall 17 is provided with ribs extending parallel to the base 16, whereby the container is collapsible in the direction perpendicularly of the wall 16.

Such a container can be manufactured for instance by initially deep-drawing a sheet of material, for instance plastic or aluminium, and subsequently plastically deforming the thus created semi-manufacture in other manner by, in the case of plastic, blow moulding or suction into a relevant shape or by deforming by means of a mould is stamp. A pouring spout 18 is moulded on the wall 17. Pouring spout 18 is provided with a lip 19. In order to close the container a cover 20 is arranged which is manufactured for instance from aluminium foil or from plastic. Cover 20 is attached by means of a thermal adhesion process to the edge 21 of wall 17.

At the position of pouring spout 18 the cover 20 is adhered to the lip 19. In the present embodiment a seam 22 is present in cover 20; in other configurations this seam can be omitted. At the position of lip 19 the cover 20 is attached by means of a thermal adhesion process to lip 19 as well as to the side walls (not shown in the drawing) of pouring spout 18. All this results in a good, fluid-tight closure. The lip 19 is provided with a tearing perforation 23 which can be torn off during use so that the part of the cover 20 located to the right of seam 22 in the drawing can be folded upward and the fluid can be dispensed from the pouring spout by for instance pressing the base 16 and cover 20 of the container between thumb and forefinger. The seam 22 can be made thinner.

Further in this embodiment the base 16 takes an elevated form to enable complete emptying of the container.

It will be apparent that it is possible to vary in diverse ways from the embodiment shown here without falling outside the scope of protection of the claims.

We claim:

1. A container, being adapted to reduce its volume through the exertion of external forces and comprising two substantially flat walls (16, 20) which are each rigid at least on their edges and which are connected by a flexible wall (17), one of the walls (16) being a base, the other of said walls (2) comprising a rim (21) connected with the flexible walls and a cover (20) connected with said rim (21), the cover (20) being adapted at least partially as a closure, characterized in that the container is adapted to contain a quantity of a fluid material;

that the container includes a closure which is arranged on a discharge spout (18) adjoining the rim (21) of the wall;

that the cover (20) is adhered to the rim (21); and that the cover also covers the discharge spout (18).

2. A container as claimed in claim 1, characterized in that the flexible wall (17) is folded in concertina shape with a directional component of the folds parallel to the rigid edges of the walls (16, 20).

3. A container as claimed in claim 1, characterized in that the rigid walls (16, 20) are round and the flexible surfaces are folded with a directional component of the folds transversely to the edges of the rigid surfaces.

4. A container as claimed in claim 1, characterized in that the container is at least partially of plastic.

5. A container as claimed in claim 1, characterized in that at least one of the walls (16) is provided with a recess.

6. A container as claimed in claim 4, wherein said plastic container is blow molded.

7. A container as claimed in claim 4, wherein said plastic container is injection molded.

* * * * *